United States Patent [19]

Gillmor

[11] Patent Number: 4,534,277

[45] Date of Patent: Aug. 13, 1985

[54] GEOMETRIC AIR PROJECTION AND CONTAINMENT

[75] Inventor: Richard H. Gillmor, 7140 Greenforest Dr., Portage, Mich. 49081

[73] Assignees: Richard H. Gillmor, Portage; Benjamin W. Wise, Richland, both of Mich.

[21] Appl. No.: 524,441

[22] Filed: Aug. 18, 1983

[51] Int. Cl.[3] ..... F24F 9/00

[52] U.S. Cl. ..... 98/36

[58] Field of Search ..... 98/36, 115 LH

[56] References Cited

U.S. PATENT DOCUMENTS

| | | | |
|---|---|---|---|
| 1,657,066 | 1/1928 | Burke | 98/36 |
| 2,516,432 | 7/1950 | Spencer | 98/36 |
| 3,086,441 | 4/1963 | London | 98/36 |
| 3,157,105 | 11/1964 | Tamm et al. | 98/36 |
| 3,768,394 | 10/1973 | Powlesland | 98/36 |
| 4,074,620 | 2/1978 | Jansson | 98/36 |
| 4,114,521 | 9/1978 | Busch | 98/36 |

FOREIGN PATENT DOCUMENTS

| | | | |
|---|---|---|---|
| 968358 | 9/1964 | United Kingdom | 98/36 |

*Primary Examiner*—Harold Joyce

*Attorney, Agent, or Firm*—Gordon W. Hueschen

[57] ABSTRACT

A process and apparatus is described which produces a geometric air projection and containment space tented over an opening in the side wall of a building in which substantially continuous sheets of ambient air are directed outwardly from around said open area into the ambient atmosphere toward a common apex in an axis which projects normally or obliquely from the opening, three said contiguous sheets intersecting at the common apex to form a tent-shaped containment space comprised within a pyramidal-shaped geometric figure, the apex of which is the confluence of the sheets. The walls of the containment space consist of said sheets sufficiently intact to prevent or minimize passage of gaseous material into the containment space except through the open area, and the sheets converge at an angle such that flow is induced into the containment space sufficient to prevent back-flow through the open area.

9 Claims, 10 Drawing Figures

GEOMETRIC AIR PROJECTION AND CONTAINMENT

BACKGROUND OF THE INVENTION

1. Field of the Invention

The invention relates to a process and apparatus for producing a geometric air projection and containment space and is particularly directed to a process and apparatus for generating such a containment space in and around an opening in a building, or the like, to prevent or minimize ingress or egress of air through said opening.

2. Prior Art

With the advent of drive-in windows at fast-food restaurants, banks, and the like, there is a need in the art for means whereby articles such as food, money, and the like, can be passed into and out of the building from a waiting car without the operator in the building being exposed to the ambient outside air.

It has been proposed heretofore to maintain openings in buildings without doors or other closures by means of a sheet of hot air acting as a screen across the opening. Similarly, it has been proposed heretofore to separate refrigerated areas in stores and shopping areas by a like screen of cold air. To be effective in these cases, the air must be hot in one case and cold in the other and, means must be provided for recovering the hot or cold air to prevent its being dissipated into the ambient.

OBJECTS OF THE INVENTION

It is an object of the invention to provide a novel process and apparatus for producing a geometric air projection and containment space which can be utilized effectively to curtain an open area from the outside ambient atmosphere while permitting the ingress and egress of articles or material through the open area. It is a further object of the invention to provide such process and apparatus which makes use of air at the ambient temperature. It is a further object of the invention to provide such a process and apparatus which can be utilized to curtain an opening in a building in which the inside ambient is at a negative pressure compared with the outside ambient. It is a further object of the invention to provide such a curtain which prevents ingress of outside ambient air, notwithstanding that the inside ambient air is at a negative pressure relative thereto. Further objects of the invention are to avoid the disadvantages of the prior art and to obtain such advantages as will be obvious to those skilled in the art or as will appear as the description proceeds.

SUMMARY OF THE INVENTION

The invention relates to a process for producing a geometric air projection and containment space tented over an area open to ambient atmosphere, which comprises directing a plurality of substantially continuous sheets of air outwardly from around said area into said ambient atmosphere and toward a common apex in an axis which projects normally or obliquely from said open area, at least two said contiguous sheets intersecting at said common apex to form a tent-shaped containment space comprised within a pointed geometric figure, the apex of which is the confluence of said sheets, the walls of said containment space consisting of said sheets of air sufficiently intact to prevent or minimize passage of gaseous material into said containment space except through said open area, any air or other gaseous material aspirated into said containment space commingling with the air in said containment space and being vented through said confluence along with the air sheeted through said confluence, and said sheets converging at an angle such that flow is induced into said containment space sufficient to prevent back-flow through said open area.

The invention also comprises one or more further features in which the sides of said geometric figure substantially completely circumscribe said open area, in which said open area is an opening into a building which is surrounded by outside ambient air into which said sheets of air are directed, in which the inside ambient is at a negative pressure compared with that of the outside ambient, in which the containment space is sufficiently intact to keep outside ambient from flowing into said building through said open area, and in which said axis projects obliquely at an angle such that none of said contiguous sheets impinge on a person in front of said open area.

The invention also relates to apparatus for producing a geometric air projection and containment space tented over an area open to ambient atmosphere which comprises sheet-jet means for directing a plurality of substantially contiguous sheets of air outwardly from around said open area into said ambient atmosphere and toward a common apex in an axis which projects normally or obliquely from said open area, at least two said contiguous sheets intersecting at said apex to form a tent-shaped containment space comprised within a pointed geometric figure, the apex of which is the confluence of said sheets, the walls of said containment space consisting of said sheets of air and being sufficiently intact to prevent or minimize passage of gaseous material into said containment space except through said open area, whereby any gaseous material aspirated into said containment space commingles with that in said containment space and is vented through said confluence along with the air sheeted through said confluence, said sheets converging at an angle such that flow is induced through said open area sufficient to prevent back-flow through said open area.

The invention also comprises one or more further features in which said sheet-jet means are arranged so that they substantially completely circumscribe said open area, in which said open area is an opening into a building which is surrounded by outside ambient air into which said sheets of air are directed, in which the inside ambient is at a negative pressure compared with that of the outside ambient and in which the containment space is sufficiently intact to keep outside ambient from flowing into said building through said open area, in which said axis projects obliquely at an angle such that none of said continuous sheets impinge on a person standing in front of said open area, in which said apparatus comprises a manifold extending around said open area, blower means for creating a positive air pressure in said manifold, and elongate, narrow, sheet-jet ports in said manifold for generating said continuous sheets, said sheet-jet ports being oriented to produce said tent-shaped containment space, in which said apparatus comprises a manifold extending around said open area, blower means for creating a positive air pressure in said manifold, and elongate, narrow, sheet-jet ports in said manifold for generating said continuous sheets, said sheet-jet ports being oriented to produce said tent-shaped containment space, in which said open area is rectangular in shape and located in a vertical wall, and in which said sheet-jet ports are located along at least the top and side walls of said manifold, in which said open area is rectangular in shape and located in a vertical wall, and in which said sheet-jet ports are located along the four sides of said open area, in which said open area is an opening in a side wall of a building and the sheet-jet ports direct said sheets of air at an angle such that there is no substantial flow of air into the building, in which said open area is an opening in a side wall of a building and the sheet-jet ports direct said sheets of air at an angle such that there is no substantial flow of air into the building, in which said sheet-jet ports direct the sheets of air obliquely to said confluence at an angle such that said confluence is sufficiently to one side of the centerline of said opening that the air sheeted through said confluence does not impinge on a person standing in front of said opening, in which said sheet-jet ports direct said sheets of air at an angle such that there is no substantial flow of air into the building, in which the sheet jet means along one side is oriented to direct the sheet of air issuing therefrom obliquely across said open area and the sheet jet means along the opposite side is oriented to direct the sheet of air issuing from it into said obliquely-jetted sheet, in which the sheet jet means on said opposite side has an outer curved surface shaped to induce a Coanda effect, in which the sheet jet means along one side is oriented to direct the sheet of air issuing therefrom obliquely across said open area and in which the sheet jet means along the top side of said open area is oriented to angle the sheet of air issuing therefrom downwardly toward said apex and comprises obliquely-arranged baffles oriented to induce a lateral shift in the sheet of air issuing therefrom in the same general direction as the obliquely-jetted sheet, and in which the sheet jet means along the top side of said open area is oriented to angle the sheet of air issuing therefrom downwardly toward said opposite side and comprises obliquely-arranged baffles oriented to induce a lateral shift in the sheet of air issuing therefrom in the same general direction as the obliquely-jetted sheet.

DESCRIPTION OF THE PREFERRED EMBODIMENTS

Figure 1:
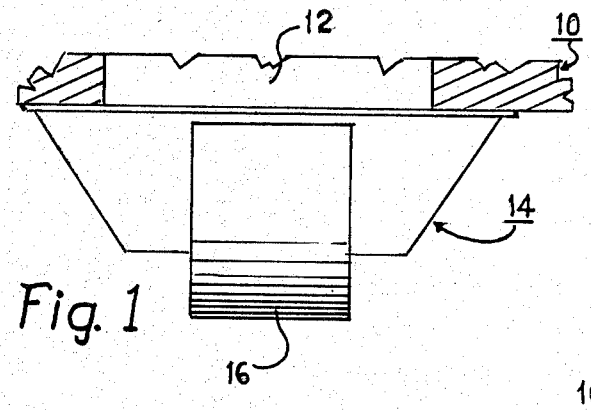
FIG. 1 is a top view of a device according to the invention applied to an opening in a building, the building being shown as a fragmentary section.
Figure 2:
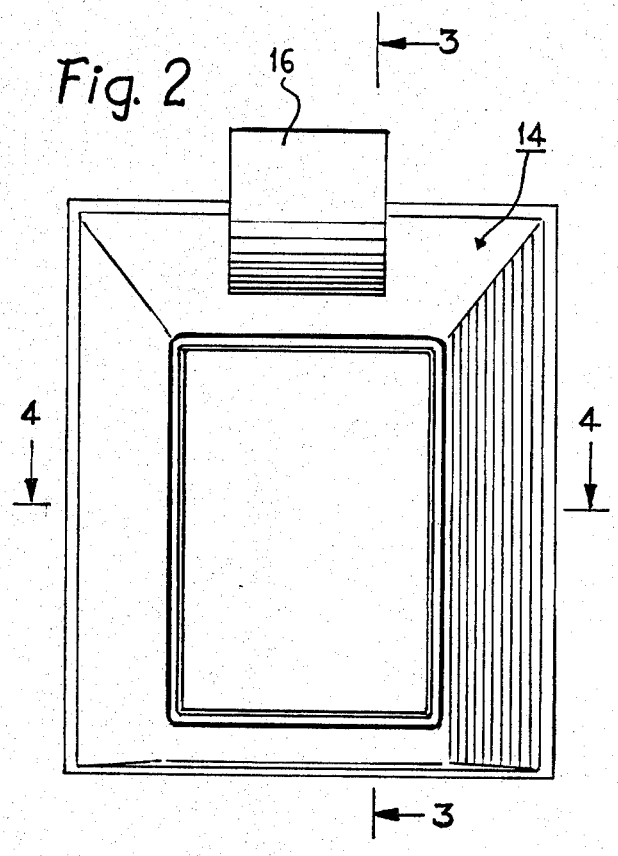
FIG. 2 is face view of one form of the invention.

Referring now particularly to FIGS. 1 through 4, 10 represents a vertical wall of a building, such as a fast-food restaurant, and 12 represents an area open to the ambient outside atmosphere. At 14 there is represented an annular manifold surrounding the open area 12, and 16 is a blower arranged to blow ambient air into the manifold 14.

The manifold 14 comprises an annular plate 18 having upstanding walls 20 and 22 extending outwardly from the inner edge of the annular plate 18. Walls 20 and 22 slope inwardly at an angle, advantageously, of about 5 degrees or more. The outer edges of these walls terminate in a common plane parallel with the annular plate 18.

Extending upwardly from the bottom outer edge of the annular plate 18 is an outer wall 26 which is spaced from the inner wall 20 and has an inturned portion 29, the end 32 of which is opposite and spaced from the top edge 20*a* of the wall 20. This provides a sheet jet port 30 extending along the bottom edge of the manifold 14, which, because of the slope of the wall 20, directs the sheet jet outwardly and upwardly away from the open area 12. At the opposite end, the wall 28 slopes downwardly from the top edge of the annular plate 18, to a point 28*a* which is out beyond the common parallel plane of the inner walls 20-22 and is opposite and spaced from the edge 20*a* of the top inner wall 20.

The slope of the top wall 28 and its spacing at 28*a* relative to the edge 20*a* of the inner wall 20 is such that the sheet of air issuing from sheet-jet port 32 is directed downwardly and outwardly at an angle which will intersect the sheet jetted out of the sheet-jet port 30 at a point below the centerline of the open area 12.

The walls 24 of the manifold slope up from the outer edge of the annular plate 18 and terminate in the common parallel plane with edges 24*a* apposed to and spaced from the edges 22*a* of the inner walls 22 to form sheet-jet ports 34 and 36. The angles of the sides 22 and the sides 24 are such as to cause the sheet-jets to be directed inwardly at an angle such that they intersect the sheet-jets issued from jet ports 30 and 32 at a common apex or substantially at a common apex, thus forming a tent-shaped containment space over the open area, the sides of which are the sheet-jets issuing from the sheet-jet ports 30, 32, 34, and 36. At these angles, and at the velocity of flow induced by the blower 16, the sheet-jets induce a flow of air from the inside of by the building through the open area into the confluence of the sheet-jets. Thus, notwithstanding that the building normally is operated at a negative pressure relative to the outside, a negative pressure induced by ventilating fans and the like, no flow of outside ambient air passes through the open area into the building.

It will be understood that in some cases, the bottom sheet-jet port 30 can be omitted without adversely affecting the geometric tent-shaped containment space and its ability to aspirate inside ambient air into the outside ambient.

In either case, there is provided an air curtain over the open area through which articles, and the like, can be passed without the necessity of opening and closing doors or windows.

Referring particularly now to FIGS. 5, 6, 7, and 8, there is shown a modification in which like reference numerals are used to illustrate the various parts, but with 100 added thereto.

The side walls 122 are cut down as compared with the side walls 22 of the other modification and angle up at 142 to the sheet-jet port 132. The latter is formed from the outer wall 128 and the inner wall 120 essentially as described in connection with FIG. 3. However, oblique baffles or vanes 144 are provided adjacent the sheet-jet port 132 for purposes that will be described.

Figure 3:
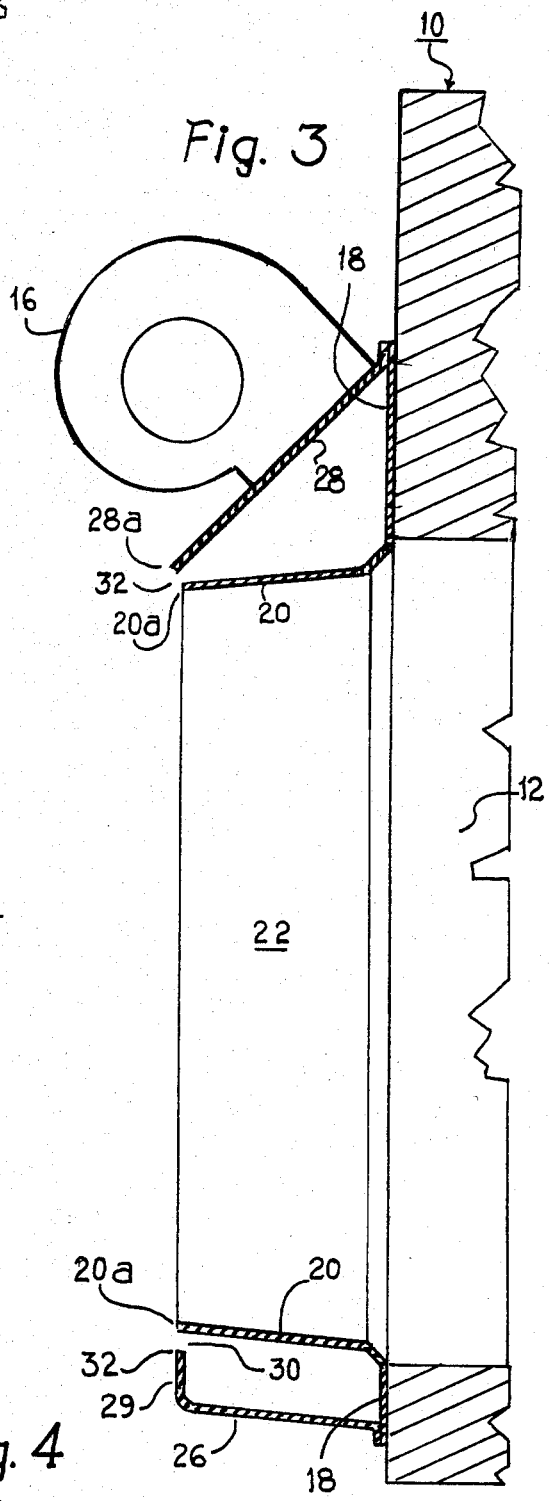
FIG. 3 is side view of FIG. 1 in section, taken along line 3—3 of FIG. 2.
Figure 5:
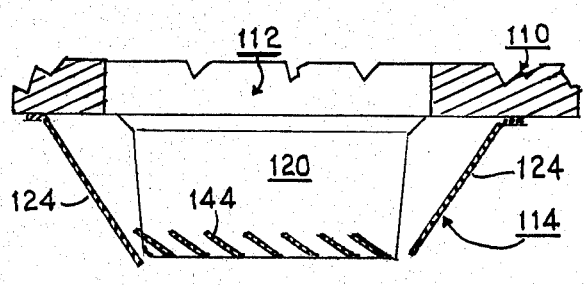
FIG. 5 is top view in section taken along line 5—5 of FIG. 6.
Figure 6:
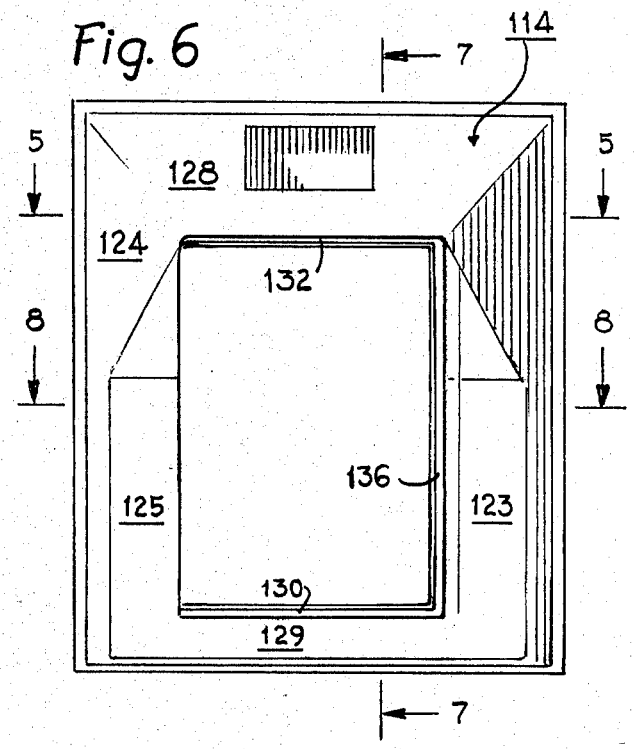
FIG. 6 is face view of a modified form of the invention.
Figure 7:
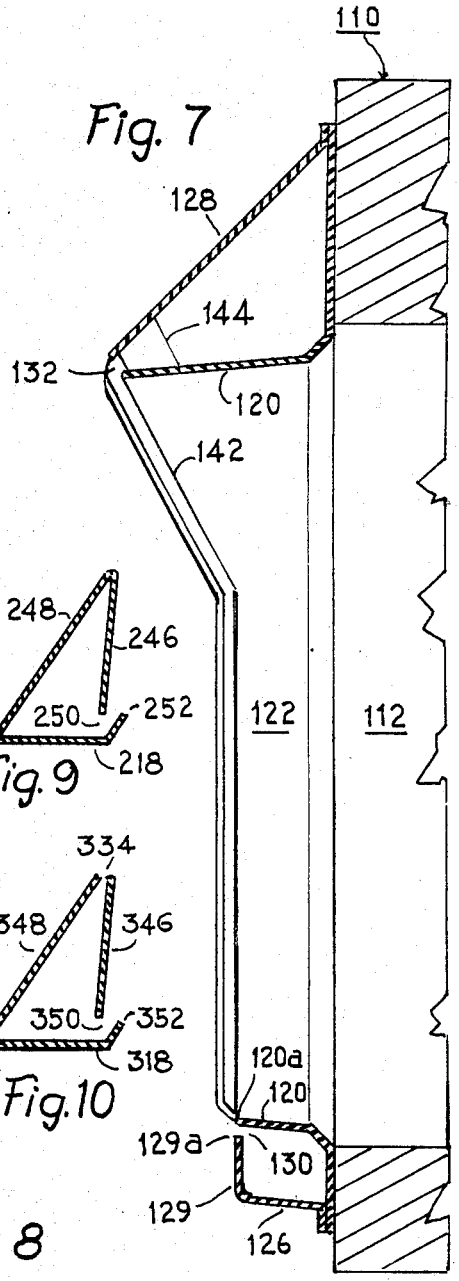
FIG. 7 is side view in section taken long line 7—7 of FIG. 6.

The end wall 126 is formed essentially as in FIG. 3, keeping in mind that the end wall is not as high as in FIG. 3. The inturned portion 129 has its edge 129*a* spaced from the edge 120*a* of the inner wall 120 to form a sheet-jet port 130, which operates in essentially the same manner as the sheet-jet port 30 of FIG. 3.

Figure 4:
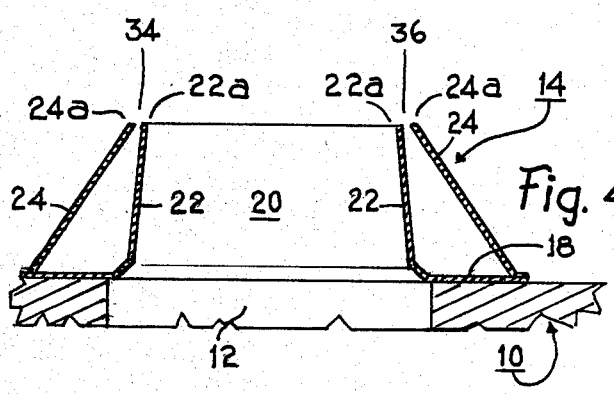
FIG. 4 is a cross-section taken along line 4—4 of FIG. 2.

The side walls 124 are truncated, as compared with those shown in FIG. 4. On the right-hand side there is provided a horizontal portion 125 which projects inwardly to a point 125*a* slightly above the edge 122*a* of the wall 122 to provide a sheet-jet port 134 which directs air obliquely across the open area in the direction of the arrows. On the opposite side, the construction is similar, but the inturned portion 123 terminates in a bent portion having a downstanding portion 138 parallel to and spaced from the inner wall 122 and a curved portion 140 which curves upwardly and outwardly from the downstanding portion 138 and back down to the horizontal portion 123. This forms a sheet-jet port 136 which has a Coanda effect which causes the sheet-jet to start out vertically, but to bend and to follow the curved portion 140 so that it is directed up and outwardly into the oblique sheet-jet from jet port 134, so that the two sheet-jet ports intersect at a point off to the side of the open area 112.

The sheet-jet issuing from the sheet-jet port 132 angles down, as described in connection with FIG. 3 but, because of the oblique vanes 144, a lateral shift is induced in the sheet of air, so that the bulk of the air issuing from the sheet-jet port 132 angles over toward the apex of the intersection of the sheets of air issuing from jet ports 134 and 136.

It is to be understood that the apex of the intersection of the several sheets of air issuing from the several jet ports, in this modification or the other one, is not necessarily a point, but can be a line, or the like, such as the ridgepole of a tent. For example, in some cases it is sufficient to direct a sheet of air obliquely across the open area from one side only and another sheet downwardly from the top sheet-jet port to intersect with the obliquely-directed sheet. In such case, it is advantageous for the top jet port to be provided with oblique baffles to effect a lateral shift of the sheet issuing therefrom in the same general direction as the obliquely-directed sheet. Thus, all that is necessary is that they intersect to form the desired geometric containment space or tent-shaped containment space.

Figure 9:
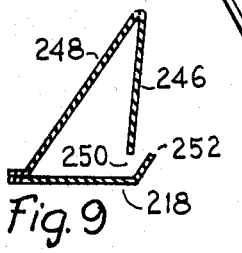
FIG. 9 is a cross-section corresponding to FIG. 4, showing a modified form of the invention.

In FIG. 9, there is shown a modification of FIG. 4, in which the inner and outer sides 246 and 248 are joined at the top and the inner side 246 is spaced from the bottom to provide a jet port 250. Similar jet ports, not shown, are provided for the other side and for each of the top and bottom walls. An annular vane 252 is spaced from these jet ports and arranged at an angle to direct the flow of the sheet of air jetted from the jet ports at an angle such that all the sheet-jets issued from the jet ports will meet in confluence at an apex.

Figure 10:
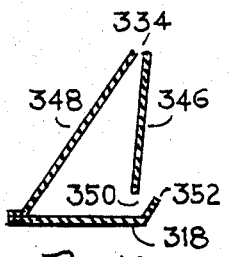
FIG. 10 is a cross-section corresponding to FIGS. 4 and 9, showing another modified form of the invention.
Figure 8:
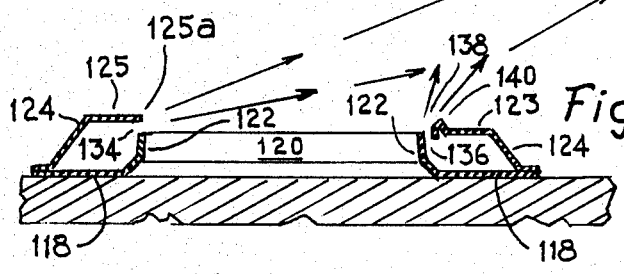
FIG. 8 is cross-section taken along line 8—8 of FIG. 6.

In FIG. 10, there is shown a modification of FIG. 9, in which, along with the jet ports 350 and the vane or upturned lip 352, there is provided jet ports 334, it being understood that the top, bottom, and other side will have like jet ports therein, so that the sheet-jets are directed outwardly from all sides, from both the top and the bottom of the annular manifold 314.

There is thus provided apparatus and process for producing a geometric air projection and containment space tented over an area open to the ambient air which acts as a curtain over the open area and prevents ingress of outside ambient air into and through the open area while at the same time permitting articles and material to be passed in and out through the open area without the necessity of doors or windows having to be opened for that purpose. The modification in FIGS. 5 through 8 is of particular advantage because, notwithstanding that sheets of air are jetted through sheet-jet ports to form the curtain, all the sheets are directed obliquely to one side of the open area so that a person standing in front of the open area is not exposed to the sheets of air thus jetted from the jet ports of the device.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. A process for producing a geometric air projection and containment space tented over an area open to ambient atmosphere, which comprises directing a plurality of substantially contiguous sheets of air outwardly from around said area into said ambient atmosphere and toward a common apex in an axis which projects obliquely from the center of said open area, said contiguous sheets intersecting at said common apex to form a tent-shaped containment space comprised within a pointed geometric figure, the apex of which is the confluence of said sheets, the walls of said containment space consisting of said sheets of air sufficiently intact to prevent or minimize passage of gaseous material into said containment space except through said open area, any air or other gaseous material aspirated into said containment space commingling with the air in said containment space and being vented through said confluence along with the air sheeted through said confluence, and said sheets converging at an angle such that flow is induced into said containment space sufficient to prevent back-flow through said open area, in which said apex is sufficiently to one side that substantially none of said contiguous sheets, or the confluence thereof, impinges on a person in front of said open area.

2. Apparatus for producing a geometric air projection and containment space tented over an area open to ambient atmosphere which comprises sheet-jet means for directing a plurality of substantially contiguous sheets of air outwardly from an opening adapted to be disposed over said open area, said sheets being directed into said ambient atmosphere and toward a common apex in an oblique plane which projects obliquely from a center line of said opening which is substantially equidistant from two said sheet jet means, said contiguous sheets intersecting at said apex to form a tent-shaped containment space comprised within a pointed geometric figure, the apex of which is the confluence of said sheets and is off center relative to said center line, the walls of said containment space consisting of said sheets of air and being sufficiently intact to prevent or minimize passage of gaseous material into said containment space except through said opening, whereby, when said apparatus is disposed with its opening over said open area, any gaseous material aspirated into said containment space through said open area and said opening commingles with that in said containment space and is vented through said confluence along with the air sheeted through said confluence, said sheets converging at an angle such that flow is induced through said opening sufficient to prevent back-flow through said open area, in which said apex is sufficiently to one side that substantially none of said contiguous sheets, or the confluence thereof, impinges on a person in front of said opening.

3. Apparatus for producing a geometric air projection and containment space tented over an area open to ambient atmosphere which comprises sheet-jet means for directing a plurality of substantially contiguous sheets of air outwardly from an opening adapted to be disposed over said open area, said sheets being directed into said ambient atmosphere and toward a common apex in an oblique plane which projects obliquely from a center line of said opening which is substantially equidistant from two said sheet jet means, said contiguous sheets intersecting at said apex to form a tent-shaped containment space comprised within a pointed geometric figure, the apex of which is the confluence of said sheets and is off center relative to said center line, the walls of said containment space consisting of said sheets of air and being sufficiently intact to prevent or minimize passage of gaseous material into said containment space except through said opening, whereby, when said apparatus is disposed with its opening over said open area, any gaseous material aspirated into said containment space through said open area and said opening commingles with that in said containment space and is vented through said confluence along with the air sheeted through said confluence, said sheets converging at an angle such that flow is induced through said opening sufficient to prevent back-flow through said open area, in which said apparatus comprises a manifold adapted to extend around said open area, blower means for creating a positive air pressure in said manifold, and elongate, narrow, sheet-jet ports in said manifold for generating said contiguous sheets, said sheet-jet ports being oriented to produce said tent-shaped containment space the apex of which is sufficiently off center that substantially none of said contiguous sheets, or the confluence thereof, impinges on a person in front of said manifold.

4. Apparatus of claim 3, in which said manifold is adapted to surround an open area which is rectangular in shape and located in a vertical wall, in which said sheet-jet ports are located along at least the top and side walls of said manifold, and in which said apex is substantially vertically aligned with one side wall of said manifold.

5. Apparatus of claim 4, in which said sheet-jet ports are located along the top and sides of said manifold.

6. Apparatus for producing a geometric air projection and containment space tented over an area open to ambient atmosphere which comprises sheet-jet means for directing a plurality of substantially contiguous sheets of air outwardly from an opening adapted to be disposed over said open area, said sheets being directed into said ambient atmosphere and toward a common apex in an oblique plane which projects obliquely from a center line of said opening which is substantially equidistant from two said sheet jet means, said contiguous sheets intersecting at said apex to form a tent-shaped containment space comprised within a pointed geometric figure, the apex of which is the confluence of said sheets and is off center relative to said center line, the walls of said containment space consisting of said sheets of air and being sufficiently intact to prevent or minimize passage of gaseous material into said containment space except through said opening, whereby, when said apparatus is disposed with its opening over said open area, any gaseous material aspirated into said containment space through said open area and said opening commingles with that in said containment space and is vented through said confluence along with the air sheeted through said confluence, said sheets converging at an angle such that flow is induced through said opening sufficient to prevent back-flow through said open area, in which the sheet jet means along one side of said opening is oriented to direct the sheet of air issuing therefrom obliquely across said opening and the sheet jet means along the opposite side is oriented to direct the sheet of air issuing from it, substantially normally to the plane of said opening so that said sheet of air is directed into said obliquely-jetted sheets substantially above said opposite side, and in which the sheet jet means on said opposite side has an outer surface which curves upwardly and away from the sheet jet so as to induce a Coanda effect.

7. Apparatus for producing a geometric air projection and containment space tented over an area open to ambient atmosphere which comprises sheet-jet means for directing a plurality of substantially contiguous sheets of air outwardly from an opening adapted to be disposed over said open area, said sheets being directed into said ambient atmosphere and toward a common apex in an oblique plane which projects obliquely from a center line of said opening which is substantially equidistant from two said sheet jet means, said contiguous sheets intersecting at said apex to form a tent-shaped containment space comprised within a pointed geometric figure, the apex of which is the confluence of said sheets and is off center relative to said center line, the walls of said containment space consisting of said sheets of air and being sufficiently intact to prevent or minimize passage of gaseous material into said containment space except through said opening, whereby, when said apparatus is disposed with its opening over said open area, any gaseous material aspirated into said containment space through said open area and said opening commingles with that in said containment space and is vented through said confluence along with the air sheeted through said confluence, said sheets converging at an angle such that flow is induced through said opening sufficient to prevent back-flow through said open area, in which a sheet jet means is disposed along one side and is oriented to direct the sheet of air issuing therefrom obliquely across said opening and in which a sheet jet means is disposed along the top side of said opening and is oriented to angle the sheet of air issuing therefrom downwardly toward said apex, said last named sheet jet means comrising obliquely-arranged baffles oriented to induce a lateral shift in the sheet of air issuing therefrom in the same general direction as the obliquely-jetted sheet.

8. Apparatus for producing a geometric air projection and containment space tented over an area open to ambient atmosphere which comprises sheet-jet means for directing a plurality of substantially contiguous sheets of air outwardly from an opening adapted to be disposed over said open area, said sheets being directed into said ambient atmosphere and toward a common apex in an oblique plane which projects obliquely from a center line of said opening which is substantially equidistant from two said sheet jet means, said contiguous sheets intersecting at said apex to form a tent-shaped containment space comprised within a pointed geometric figure, the apex of which is the confluence of said sheets and is off center relative to said center line, the walls of said containment space consisting of said sheets of air and being sufficiently intact to prevent or minimize passage of gaseous material into said containment space except through said opening, whereby, when said apparatus is disposed with its opening over said open area, any gaseous material aspirated into said containment space through said open area and said opening commingles with that in said containment space and is vented through said confluence along with the air sheeted through said confluence, said sheets converging at an angle such that flow is induced through said opening sufficient to prevent back-flow through said open area, in which the sheet jet means along one side of said opening is oriented to direct the sheet of air issuing therefrom obliquely across said opening and the sheet jet means along the opposite side is oriented to direct the sheet of air issuing from it, substantially normally to the plane of said opening so that said sheet of air is directed into said obliquely-jetted sheets substantially above said opposite side, and in which the sheet jet means along the top side of said open area is oriented to angle the sheet of air issuing therefrom downwardly toward said opposite side and comprises obliquely-arranged baffles oriented to induce a lateral shift in the sheet of air issuing therefrom in the same general direction as the obliquely-jetted sheet.

9. Apparatus for permitting access to the interior of a building through an opening therein comprising a manifold having spaced-apart side portions lying in a common plane, which manifold is adapted to be mounted around said opening, and sheet jet means in said side portions for jetting substantially contiguous sheet jets therefrom, the sheet jet means on one side portion being oriented to direct its sheet jet obliquely toward the other side portion at an acute angle to said common plane and the sheet jet means on the other side portion being oriented to direct its sheet jet at an angle to said common plane which is substantially greater than said acute angle, in which the last named sheet jet means has port means which initially directs the sheet jet at an angle of about 90 degrees to said common plane and has Coanda effect means tending to deflect the sheet jet means into an angle greater than 90 degrees.

* * * * *